US009088073B2

(12) United States Patent
Leung et al.

(10) Patent No.: US 9,088,073 B2
(45) Date of Patent: Jul. 21, 2015

(54) HIGH ISOLATION SINGLE LAMBDA ANTENNA FOR DUAL COMMUNICATION SYSTEMS

(75) Inventors: Chun Kai Leung, Hong Kong (HK); Corbett Ray Rowell, Hong Kong (HK); Tik Shun Leung, Hong Kong (HK); Kuang Boon Beh, Hong Kong (HK)

(73) Assignee: Hong Kong Applied Science and Technology Research Institute Company Limited, Hong Kong Science Park, Shatin, New Territories, Hong Kong (CN)

( * ) Notice: Subject to any disclaimer, the term of this patent is extended or adjusted under 35 U.S.C. 154(b) by 248 days.

(21) Appl. No.: 13/402,893

(22) Filed: Feb. 23, 2012

(65) Prior Publication Data

US 2013/0222186 A1 Aug. 29, 2013

(51) Int. Cl.

| | |
|---|---|
| ***H01Q 1/38*** | (2006.01) |
| ***H01Q 1/52*** | (2006.01) |
| ***H01Q 9/42*** | (2006.01) |
| ***H01Q 21/30*** | (2006.01) |

(52) U.S. Cl.

CPC ..... *H01Q 1/521* (2013.01); *H01Q 9/42* (2013.01); *H01Q 21/30* (2013.01)

(58) Field of Classification Search

USPC ..... 343/700 MS, 702, 770

See application file for complete search history.

(56) References Cited

U.S. PATENT DOCUMENTS

| | | | | |
|---|---|---|---|---|
| 6,842,141 | B2 * | 1/2005 | Suh et al. | 343/700 MS |
| 7,443,810 | B2 * | 10/2008 | Boyle | 370/281 |
| 7,616,158 | B2 * | 11/2009 | Mak et al. | 343/700 MS |
| 7,629,930 | B2 * | 12/2009 | Murch et al. | 343/700 MS |
| 2007/0069960 | A1 * | 3/2007 | Moon et al. | 343/700 MS |
| 2009/0009400 | A1 * | 1/2009 | Kim et al. | 343/700 MS |
| 2009/0275370 | A1 | 11/2009 | Schlub et al. | |

(Continued)

FOREIGN PATENT DOCUMENTS

| | | | |
|---|---|---|---|
| CN | 1647311 | A | 7/2005 |
| CN | 202058856 | U | 11/2011 |
| WO | 2007141665 | A2 | 12/2007 |

OTHER PUBLICATIONS

Office Action issued from the State Intellectual Property Office of the People's Republic of China on Dec. 10, 2013, including a search report.

(Continued)

*Primary Examiner* — Hoang V Nguyen
*Assistant Examiner* — Hai Tran
(74) *Attorney, Agent, or Firm* — Ella Cheong Hong Kong

(57) ABSTRACT

An antenna system includes an antenna element having two antenna feeds and a shared connection to a ground plane. A first antenna portion has a first resonant frequency length of at least one first wavelength formed from a first feed together with the shared ground connection. A second antenna portion has a second resonant frequency length formed from a second feed together with the shared ground connection. First and second slots are respectively positioned between the shared ground connection and the respective first and second feeds such that the slots create inductances. At least a portion of the ground plane is located directly beneath at least a portion of the first and second slots. The first and second slot inductances together with the ground plane capacitances form one or more filter components to isolate the first and second resonant frequencies in the antenna element.

17 Claims, 5 Drawing Sheets

(56) References Cited

U.S. PATENT DOCUMENTS

| | | | | |
|---|---|---|---|---|
| 2010/0123631 | A1* | 5/2010 | Chang et al. | 343/700 MS |
| 2010/0195753 | A1* | 8/2010 | Yamamoto et al. | 375/267 |

OTHER PUBLICATIONS

Office Action issued from the State Intellectual Property Office of the People's Republic of China on May 23, 2014, including a search report.

* cited by examiner

*Different Angles*

*Meandering*

HIGH ISOLATION SINGLE LAMBDA ANTENNA FOR DUAL COMMUNICATION SYSTEMS

FIELD OF THE INVENTION

The invention relates to antenna systems in general and, more particularly, to antenna systems having a single antenna element and a single ground plane with two independent antenna feeds and isolation between the two antenna feed paths.

BACKGROUND

As antenna systems grow smaller, space between antenna elements in those systems becomes more scarce. Not only does the spacing between antenna elements have the potential to affect the radiation pattern of a system, but it can also affect the amount of mutual coupling between antenna elements. Mutual coupling is inductive/capacitive coupling between two or more antennas, and it can sometimes result in unwanted performance degradation by interfering with signals being transmitted or by causing an antenna element to radiate unwanted signals. Generally, the closer the placement of two antenna elements, the higher the potential for mutual coupling.

Accordingly, modern antenna designers generally look for ways to decrease coupling (i.e., increase isolation) between some antenna elements. This is especially true for multi-channel systems, as the signals on one channel should usually and ideally be unaffected by the signals on other channels and antenna systems which require plural antennas to operate at the same frequency or in a close frequency band but to work independently of each other.

Some antenna systems employ antenna elements placed above a ground plane. In such systems, the antenna elements can induce currents in the ground plane that travel to other antenna elements and increase undesired coupling. To decrease the coupling, various techniques have been devised. For example, one solution has been to split the ground plane so that two antennas that might interfere are not connected by a continuous ground plane. However, such systems generally produce an inadequate amount of isolation.

In U.S. Pat. No. 7,629,930 a three-dimensional antenna system is disclosed in which first and second antenna elements are positioned above a ground plane. A bandstop filter is positioned in the ground plane to attenuate signals caused by mutual coupling. While the use of a bandstop filter in this configuration assists in antenna element isolation, there remains a need in the art for improved antenna element isolation in other antenna configurations.

SUMMARY OF THE INVENTION

The invention provides an antenna system including an antenna element with monopole-like behavior having two antenna feeds and a single shared connection to a ground plane. In one embodiment, a single antenna element includes two antenna portions. The first portion has a first resonant frequency length of at least one first wavelength formed from a first antenna feed together with the shared ground connection. The second portion has a second resonant frequency length of at least one second wavelength formed from a second antenna feed together with the shared ground connection.

A first slot is placed between the first antenna feed and the ground connection on the antenna element such that the first slot creates a first inductance. At least a second slot is placed between the second antenna feed and the ground connection on the antenna element such that the second slot creates a second inductance.

The ground plane is positioned with a portion of the ground plane located directly beneath at least a portion of the first slot and beneath at least a portion of the second slot such that capacitances are formed. The first and second slot inductances together with the ground plane capacitances form one or more filter components to isolate the first and second resonant frequencies in the first and second antenna element portions of the antenna element.

Advantageously, a single antenna element having two independent radiating portions is formed with a single ground plane. The configuration has both good impedance matching and good isolation of the first and second antenna element portions.

DETAILED DESCRIPTION

Figure 1:
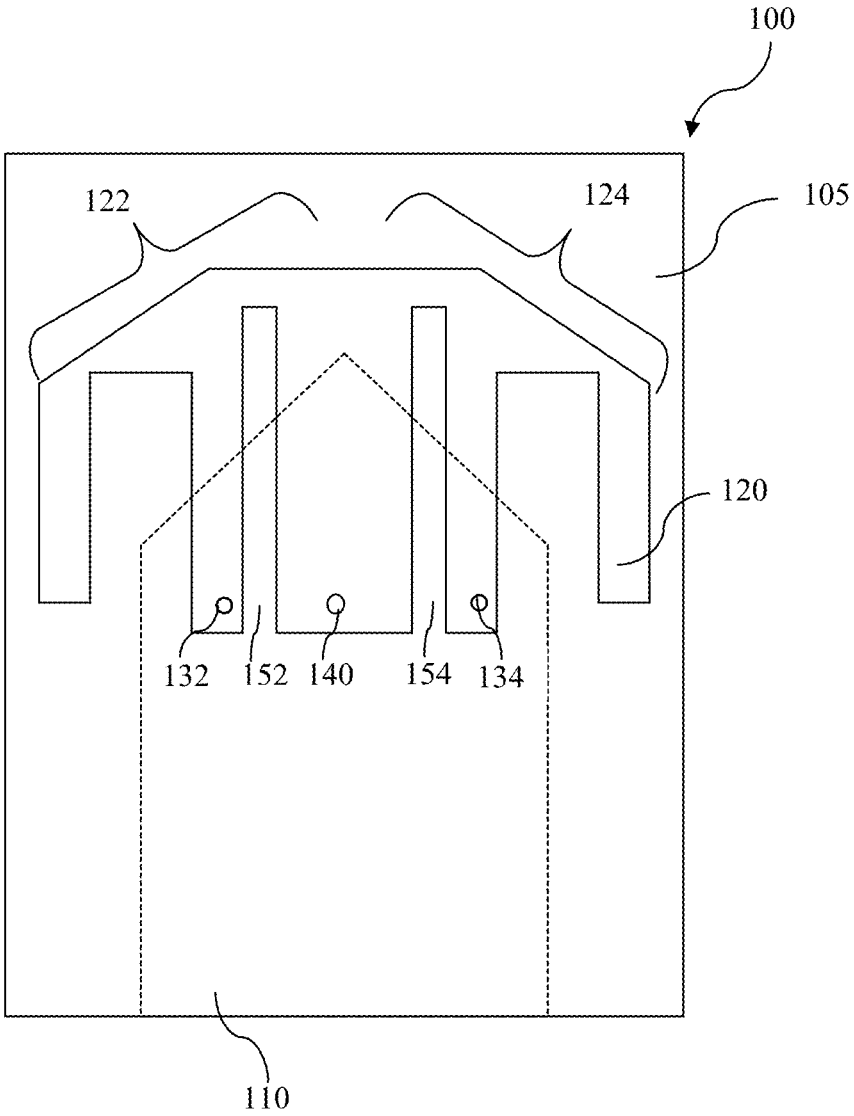
FIG. 1 is an antenna system according to one embodiment of the present invention.

FIG. 1 schematically depicts an antenna system 100 according to one embodiment of the present invention. System 100 includes a single antenna element 120 and a single ground plane 110. Antenna element 120 includes first and second radiating plane portions 122 and 124 (also described as first and second antenna portions) merged together to form the single antenna element 120. The two antenna element portions share a single ground connection 140. Each of the radiating portions 122 and 124 of antenna element 120 are respectively fed by first antenna feed 132 and second antenna feed 134.

In the exemplary embodiment of FIG. 1, the antenna element 120 is positioned on the upper surface of a substrate 105 while the ground plane 110 is positioned on the lower surface of substrate 105 (indicated by the dashed lines in FIG. 1). Substrate 105 can be a printed circuit board with ground plane 110 and antenna 120 disposed on opposite surfaces of the printed circuit board. Alternatively, substrate 105 can be selected from one or more dielectric materials. Ground connection 140 is a conductive via in the printed circuit board or any other suitable conductive connection to the ground plane.

The resonance length of each antenna element portion is a single wavelength in a desired wireless communication band. An exemplary communication band is the ISM (Industrial, Scientific, Medical) band having a frequency in the range of approximately 2.4 GHz to 2.5 GHz. Other wavelengths may be selected depending upon the desired antenna application. The overall frequency response of each antenna element portion 122 and 124 is dependent on the resonance lengths of the various segments making up each antenna element portion. Generally, as the length of a portion increases, the resonant length increases. As the width increases, capacitive loading also increases which will affect the electrical field distribution of an antenna portion; this makes the electrical length longer for the overall physical dimensions which lowers the resonant frequency. Thus the overall antenna portion geometry must be considered to create the desired resonant frequency. Note that the first and second resonant frequencies may be the same or different; in an exemplary embodiment the resonant frequencies are within 10% of each other.

Exemplary planar antenna configurations are depicted in FIG. 3. FIGS. 3A and 3C show antenna element portions disposed at various angles which may enhance isolation of each antenna portion, particularly the orthogonal configuration of FIG. 3C. FIGS. 3D and 3E show meandering paths/folded antenna element portions.

Turning back to FIG. 1, the two antenna feed elements 132 and 134 are positioned in each of the antenna element portions 122, 124 of antenna element 120. Two slots, labeled 152 and 154, are respectively positioned between ground connection 140 and each of the antenna feeds 132 and 134.

Figure 4A:
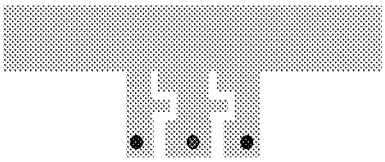
FIGS. 4A-4C show exemplary slot configurations for the antenna system of the present invention.
Figure 4C:
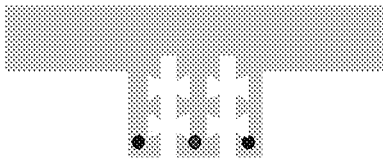
Figure 4B:
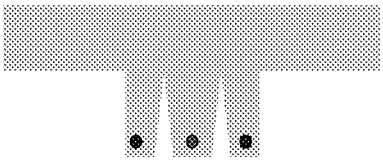
Figure 5A:
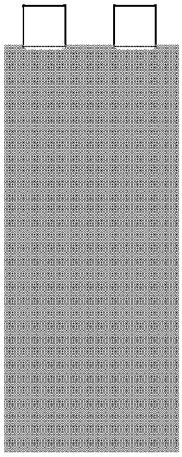
FIG. 5 depicts exemplary ground plane configurations for the antenna system of the present invention.
Figure 5B:
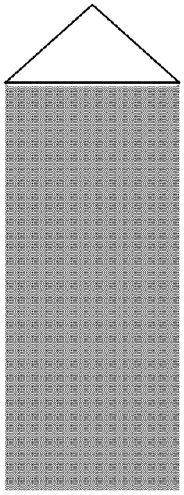
Figure 5C:
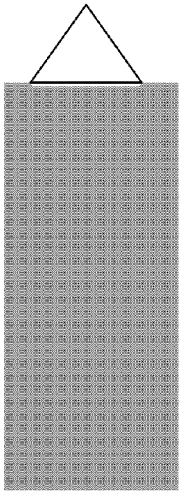
Figure 5D:
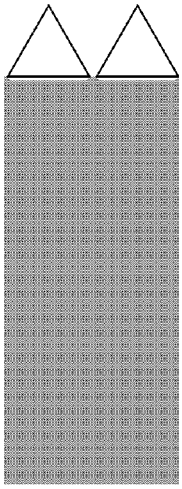
Figure 5E:
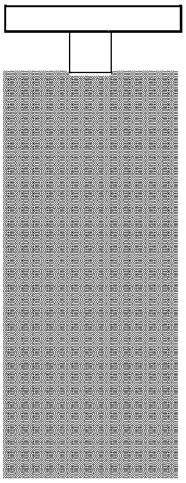

The slots affect the impedance matching of each antenna element portion since each slot creates an inductance. The exact slot dimensions determine the inductance and thus the impedance matching characteristics. FIGS. 4A-4C depict various slot configurations. FIG. 4A depicts a meandering slot path; FIG. 4B depicts a slot having a width that varies along the slot length creating a variable inductance. In FIG. 4C, various stubs are formed off the main slot. These stubs, in connection with capacitance added by a ground plane extension, can block various specific frequencies.

As seen in FIG. 1, a portion of ground plane 110 "overlaps" a portion of each of inductance slots 152 and 154 (the ground plane is positioned on the reverse side of the substrate while the antenna is positioned on the front side). This creates capacitances which, in combination with the inductances, create the equivalent of an isolation band-stop filter. However, the extension of the ground plane to overlap the slots will further affect the impedance matching due to the additional capacitances that are introduced. Therefore the inductances and capacitances are balanced to ensure both adequate impedance matching and adequate isolation.

Various ground plane extension geometries are employed to balance the inductances and capacitances in the antenna element as seen in FIG. 5. Note that the term "ground plane extension" reference to the portion of the ground plane that overlaps the inductance slots. However, the ground plane is still a single, contiguous element. Thus the term "ground plane" includes these ground plane extensions which are discussed separately here to facilitate a discussion of the geometry aspects. The ground plane extension size and shape(s) is selected in connection with the inductance slot size and shape to create the desired overall balance of impedance matching and isolation. As seen in FIG. 5, the ground plane extension can be a single element (such as the triangular element of FIGS. 1, 5B and 5C) or it can be plural elements that together form the ground plane extension (FIGS. 5A, 5D, and 5E).

Figure 2:
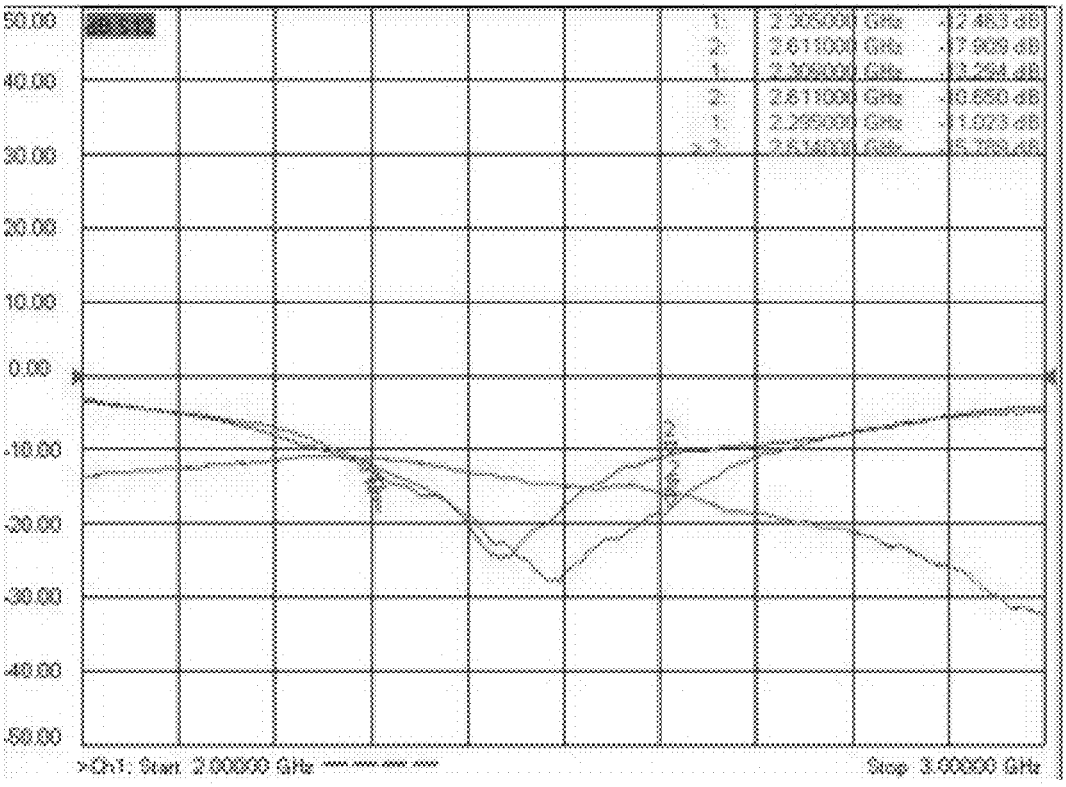
FIG. 2 is a plot of signal strength vs. frequency showing good impedance matching and isolation for the antenna system of FIG. 1.
Figure 3A:
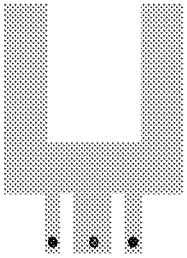
FIGS. 3A-3E depict various antenna element configurations of antenna systems of the present inventions.
Figure 3B:
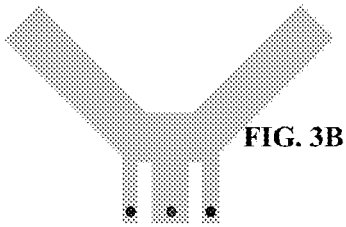
Figure 3C:
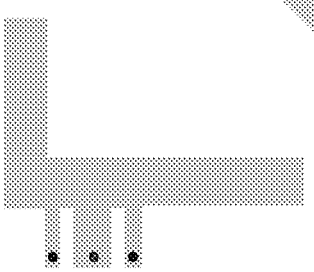
Figure 3D:
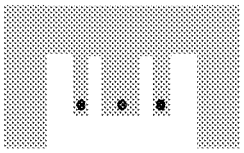
Figure 3E:
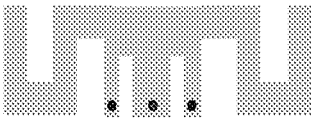

As seen in FIG. 2, for the antenna system of FIG. 1, sufficient isolation as well as sufficient impedance matching are achieved in the ISM frequency band.

INDUSTRIAL APPLICABILITY

The present invention finds utility in numerous wireless communication systems. An exemplary application is a light fixture or other electrical appliance with a wireless motion sensor module that uses one antenna portion and a second receiver or transceiver that uses the second antenna portion.

The foregoing has outlined the features and technical advantages of the present invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

The invention claimed is:

1. An antenna system comprising:

an antenna element;

a ground plane; and a substrate wherein the antenna element is a planar conductive material disposed on a first surface of the substrate and the ground plane is a planar conductive material disposed on a second surface of the substrate;

the antenna element comprising:

a first antenna element portion having a first radiating plane, a first resonant frequency and a first resonant frequency length, the first resonant frequency length being formed from a first antenna feed together with a shared ground connection coupled to the ground plane, the shared ground connection being conductively connected to the ground plane through the substrate, the first antenna feed being positioned in the first antenna element portion, wherein the first resonant frequency length is formed by resonance lengths of first segments making up the first antenna element portion, and wherein the first segments include the first radiating plane, the first antenna feed and the shared ground connection;

a second antenna element portion having a second radiating plane, a second resonant frequency and a second resonant frequency length, the second resonant frequency length being formed from a second antenna feed together with the shared ground connection, the second antenna feed being positioned in the second antenna element portion, wherein the second resonant frequency length is formed by resonance lengths of second segments making up the second antenna element portion, said second segments including the second radiating plane, the second antenna feed and the shared ground connection;

at least a first slot placed between the first antenna feed and the shared ground connection to create a first inductance;

at least a second slot placed between the second antenna feed and the shared ground connection to create a second inductance;

wherein:

the first and the second antenna element portions form two independent radiating portions sharing one single ground plane;

the ground plane only partially overlaps the first slot to create a first capacitance, and the second slot to create a second capacitance;

the first inductance, the first capacitance, the second inductance and the second capacitance create an equivalent of an isolation band-stop filter for increasing the isolation between the first and second resonant frequencies in the first and second antenna element portions of the antenna element; and the ground plane has a size and a shape both selected based on sizes and shapes of the first slot and of the second slot so as to create a desired overall balance of impedance matching of each antenna element portion and isolation between the two antenna element portions.

2. An antenna system according to claim 1 wherein the first and second resonant frequencies are within 10% of each other.

3. An antenna system according to claim 1 wherein the substrate is selected from one or more dielectric materials.

4. An antenna system according to claim 3 wherein the connection to the ground plane is through a conductive via in the substrate between the first and the second surfaces.

5. An antenna system according to claim 1 wherein the antenna element further comprises one or more planar folded arm antenna portions.

6. An antenna system according to claim 1 wherein the antenna element further comprises first and second orthogonal arm portions.

7. An antenna system according to claim 1 wherein at least one of the first and the second slots has a varying slot geometry along a slot length such that a distributed inductance is formed.

8. An antenna system according to claim 1 wherein at least one of the first and the second slots has a width that varies along a length of the slot.

9. An antenna system according to claim 1 wherein the portion of the ground plane located directly beneath a portion of the first slot and a portion of the second slot comprises one or more ground plane extension elements.

10. An antenna system according to claim 1 wherein the first and second resonant frequencies are the same or different and are located in a frequency band of approximately 2.4 GHz to 2.5 GHz.

11. An antenna system according to claim 1 wherein the first inductance, the second inductance, the first capacitance and the second capacitance altogether form one or more filtering components to isolate the first and second resonant frequencies in the first and second antenna element portions of the antenna element.

12. An antenna system according to claim 11 wherein the one or more filtering components form the band-stop filter.

13. An antenna system according to claim 1 wherein the substrate is a printed circuit board.

14. An antenna system according to claim 1, wherein the first resonant frequency has at least one first resonant wavelength, and wherein a path length from the first antenna feed together with the shared ground connection includes the first resonant wavelength.

15. An antenna system according to claim 1, wherein the second resonant frequency has at least one second resonant wavelength, and wherein a path length from the second antenna feed together with the shared ground connection includes the second resonant wavelength.

16. An antenna system comprising:

an antenna element comprising at least first and second antenna element portions;

a ground plane; and a substrate wherein the antenna element is a planar conductive material disposed on a first surface of the substrate and the ground plane is a planar conductive material disposed on a second surface of the substrate;

wherein:

the first and the second antenna element portions form two independent radiating portions sharing one single ground plane;

the first antenna element portion has a first antenna feed, the first antenna feed being positioned in the first antenna element portion;

the second antenna element portion has a second antenna feed independent of the first antenna feed, the second antenna feed being positioned in the second antenna element portion;

the first and second antenna element portions have a shared ground connection to the ground plane, the shared ground connection being conductively connected to the ground plane through the substrate;

the first antenna element portion has a first resonant frequency range having at least one first resonant wavelength, and a path length from the first antenna feed together with the shared ground connection includes the first resonant wavelength; and the second antenna element portion has a second resonant frequency range having at least one second resonant wavelength and a path length from the second antenna feed together with the shared ground connection includes the second resonant wavelength;

the antenna element further comprises:

(a) at least a first slot placed between the first antenna feed and the shared ground connection on the antenna element, the first slot creating a first inductance; and (b) at least a second slot placed between the second antenna feed and the shared ground connection on the antenna element, the second slot creating a second inductance;

the ground plane only partially overlaps the first slot to create a first capacitance, and the second slot to create a second capacitance;

the first inductance, the first capacitance, the second inductance and the second capacitance create an equivalent of an isolation band-stop filter for increasing the isolation between the first and second resonant frequencies in the first and second antenna element portions of the antenna element; and the ground plane has a size and a shape both selected based on sizes and shapes of the first slot and of the second slot so as to create a desired overall balance of impedance matching of each antenna element portion and isolation between the two antenna element portions.

17. An antenna system according to claim 16, wherein:

the first antenna element portion further includes a first radiating plane;

the first resonant frequency length is formed by resonance lengths of first segments making up the first antenna element portion, said first segments including the first radiating plane, the first antenna feed and the shared ground connection;

the second antenna portion further includes a second radiating plane; and the second resonant frequency length is formed by resonance lengths of second segments making up the second antenna element portion, said second segments including the second radiating plane, the second antenna feed and the shared ground connection.

* * * * *